United States Patent [19]

Ostby

[11] Patent Number: 4,760,364

[45] Date of Patent: Jul. 26, 1988

[54] ELECTROMAGNETIC CONTACTOR HAVING IMPROVED STRUCTURE AND ASSEMBLY

[75] Inventor: Marvin E. Ostby, Brookfield, Wis.

[73] Assignee: Eaton Corporation, Cleveland, Ohio

[21] Appl. No.: 901,713

[22] Filed: Aug. 28, 1986

[51] Int. Cl.[4] ..... H01H 67/02

[52] U.S. Cl. ..... 335/132; 335/202; 200/293

[58] Field of Search ..... 335/131, 132, 133, 202, 335/134, 135, 139, 160, 120; 200/50 C, 147 R, 293, 295

[56] References Cited

U.S. PATENT DOCUMENTS

| | | | |
|---|---|---|---|
| 1,801,173 | 4/1931 | Petersen | 200/295 |
| 2,898,427 | 8/1959 | Nadeau | 200/144 |
| 3,469,215 | 9/1969 | Brovedan | 335/132 |
| 3,525,961 | 8/1970 | Marien | 335/202 |
| 3,727,157 | 4/1973 | Grunert et al. | 335/132 |
| 4,087,770 | 5/1978 | Kuhn et al. | 335/132 |
| 4,525,694 | 6/1985 | Dennison et al. | 335/132 |
| 4,544,814 | 10/1985 | Butterworth et al. | 200/50 C |

*Primary Examiner*—E. A. Goldberg
*Assistant Examiner*—Lincoln Donovan
*Attorney, Agent, or Firm*—L. G. Vande Zande

[57] ABSTRACT

An enclosure for an electromagnetic contactor is provided with upper (2) and lower (4) housings and a cover (6) over the upper housing (2), all comprised of molded insulating material. The upper housing (2) is joined to the lower housing (4) by inserting its lugs (*2m,2n*) in notches (*4e,4f*) and rocking it so that a pair of hooks (*2o,2p*) enter corresponding holes (*4g,4h*) at one end and a clamp (26) is pressed over a catch (*2q*) at the other end. A leaf bias spring (30) between the magnet frame (28) and the molded coil (32) applies force to the molded coil (32) which is pressed against the upper housing (2) so that the coil will not move but allows the magnet frame to align with the armature (40) or to move under armature impact, takes up slack between the upper (2) and lower (4) housings, biases the coil (32) rigidly against the upper housing (2) and allows the magnet (38,40) to move relative to the housings (2,4). Blowouts (46) are press-in held in the cover (6) for correct positioning when the cover is assembled. Inclines (*32f*) on the top of the coil (32) guide the return spring (42) into correct centered position when the upper housing (2) is rocked in assembly onto the lower housing (4). The upper (2) and lower (4) housings, cover (6), blowouts (46) bias spring (30) and contact carrier (24) are keyed to allow only correct orientation relative to one another in assembly. An alternative version uses another leaf spring (48) between the lower housing (4) and the coil (32).

13 Claims, 6 Drawing Sheets

Fig. 8
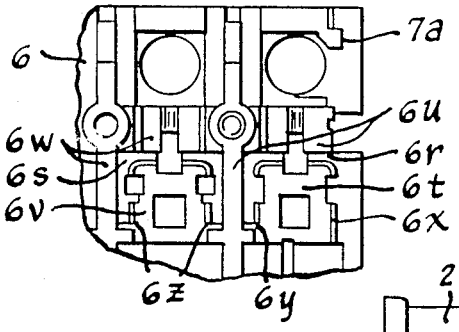
Fig. 9
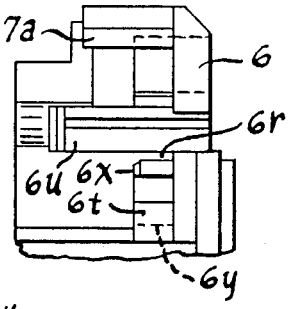
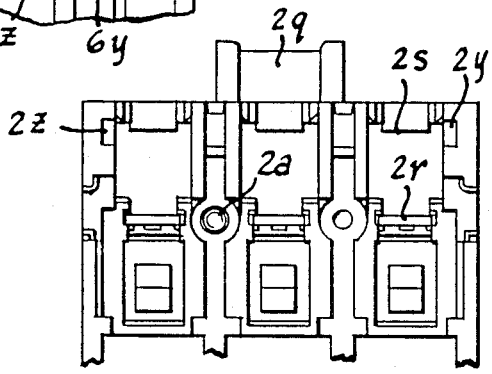
Fig. 10
Fig. 11
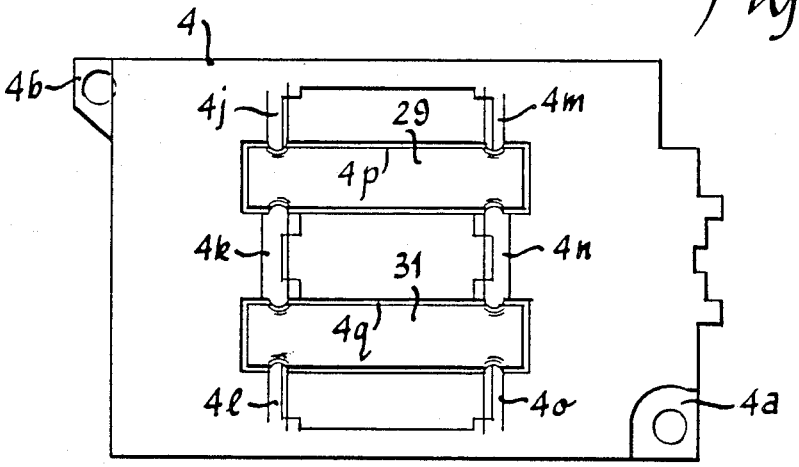

ELECTROMAGNETIC CONTACTOR HAVING IMPROVED STRUCTURE AND ASSEMBLY

BACKGROUND OF THE INVENTION

Electromagnetic contactors having various configurations have been known heretofore. For example, K. A. Grunert et al. Pat. No. 3,727,157, dated April 10, 1973, shows an electromagnetic contactor wherein the magnet frame is used as a mounting bracket and is arranged to be connected by a pair of screws to a mounting panel. A pair of wire clips having spaced portions engagable with the housing and the mounting bracket are used for readily detachably mounting the housing on the bracket and for readily detaching the housing from the bracket for enabling easy access to the interior of the assembly without removing the bracket (magnet frame) from the mounting panel. Also, A. Brovedan Pat. No. 3,469,215, dated Sept. 23, 1969, and E. H. Kuhn Pat. No. 4,087,770, dated May 2, 1978, show electromagnetic relays having a pair of cushions or elastomer pads between the magnet frame and the housing and between the magnet frame and the coil to absorb any shocks imposed on the magnet frame when the armature is actuated. A separate spring clip presses the coil against the magnet frame and the magnet frame against the base of the housing in the Brovedan patent. In the Kuhn et al patent the upper housing part is attached to the lower housing part by four screws and presses down on the encapsulated coil so as to compress slightly the rubber cushions and retain the coil and the magnet yoke within the magnet housing. While these prior contactors and relays have been useful for their intended purposes, they have nevertheless been handicapped by certain disadvantages such as difficulty of assembly and disassembly, parts being subject to undesired movement under shock and vibration if held together by readily detachable means, and difficulty of mounting accessory devices such as mechanical and electrical interlocks, auxiliary contacts and switches. This invention relates to improvements thereover.

SUMMARY OF THE INVENTION

An object of the invention is to provide an improved electromagnetic contactor.

A more specific object of the invention is to provide an electromagnetic contactor with improved means whereby it can be assembled as upper and lower subassemblies which can then be readily joined together while insuring that the cooperating parts therebetween are properly and securely positioned.

Another specific object of the invention is to provide an electromagnetic contactor with improved means providing a strong bias force between the upper and lower housings so that the housings will be held relatively steady under shock and vibration conditions.

Another specific object of the invention is to provide an electromagnetic contactor with improved means that allows the magnet to move a certain amount to line up with the armature for effective and efficient armature operation while taking up any slack between the upper and lower housings to prevent relative movement therebetween under shock and vibration conditions.

Another specific object of the invention is to provide an electromagnetic contactor with improved means for mounting an additional pole on either side wall thereof.

Another specific object of the invention is to provide an electromagnetic contactor with improved arc blowout members that are press-in mounted for automatic positioning relative to the contacts on assembly of the device.

Another specific object of the invention is to provide an electromagnetic contactor with improved means where the plurality of parts thereof are keyed for correct orientation thereof in assembly and to prevent incorrect assembly thereof.

Other objects and advantages of the invention will hereinafter appear.

These and other objects and advantages of the invention are attained by providing an electromagnetic contactor having a molded insulating enclosure including a lower housing and an upper housing including means for fixing said upper housing onto said lower housing and connecting the same together, stationary and movable contacts in said upper housing, an insulating molded contact carrier supporting said movable contacts and means guiding said contact carrier for reciprocal movement in said upper housing, an electromagnet comprising an E-shaped magnet frame, a coil, means supporting said magnet frame and coil in said lower housing, an armature secured to said contact carrier and a return spring normally biasing said armature away from said frame for attraction by said magnet frame when said coil is energized to operate said contacts; characterized in that said means fixing said upper housing onto said lower housing comprises retaining and pivoting means at one end of said upper housing and said lower housing to afford hooking of said upper housing onto said lower housing and rocking said upper housing into assembled position on said lower housing, securing means for attaching the other end of said upper housing to said lower housing to join said upper housing to said lower housing, and means insuring correct location of said return spring when said upper and lower housings are joined.

BRIEF DESCRIPTION OF THE DRAWINGS

FIG. 8 is a fragmentary bottom view of the cover which forms a part of the upper housing showing one of the two keys in the corners of the left end thereof that key the cover for correct orientation with respect to the upper housing.

FIG. 9 is a fragmentary front view of the portion of the cover shown in FIG. 8 to show a front view of the key therein.

FIG. 10 is a fragmentary top view of the left end portion of the upper housing showing the two keyways for receiving the keys of the cover.

FIG. 11 is a top schematic view looking into the lower housing with the magnet removed showing the shock absorbing pads therein down onto which the magnet frame is biased.

DESCRIPTION OF THE PREFERRED EMBODIMENTS

Figure 1:
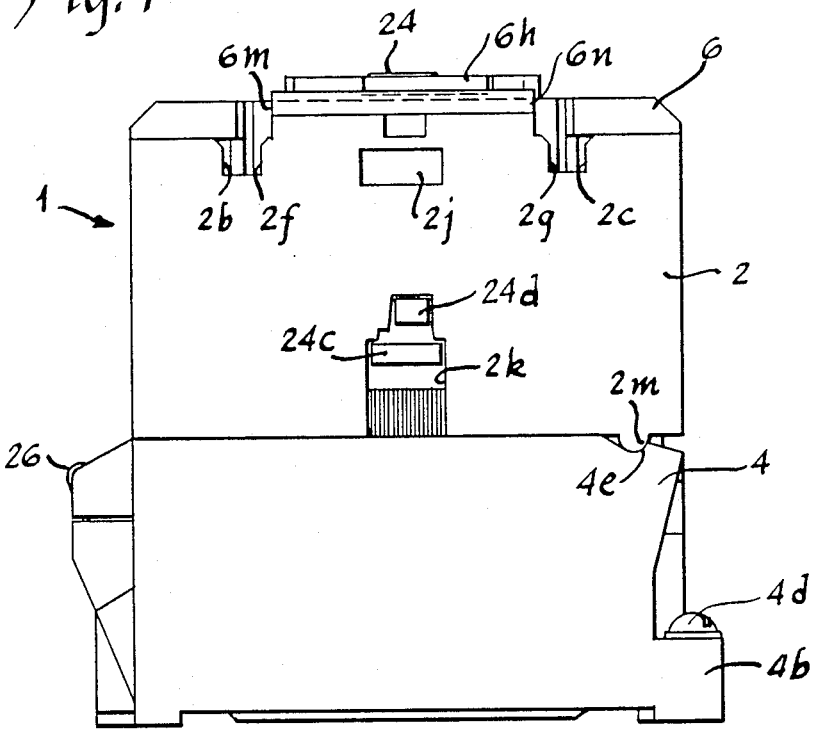
FIG. 1 is a front elevational view of an electromagnetic contactor constructed in accordance with the invention and showing the exterior configuration thereof including the additional pole mounting structure on the front wall of the upper housing.
Figure 2:
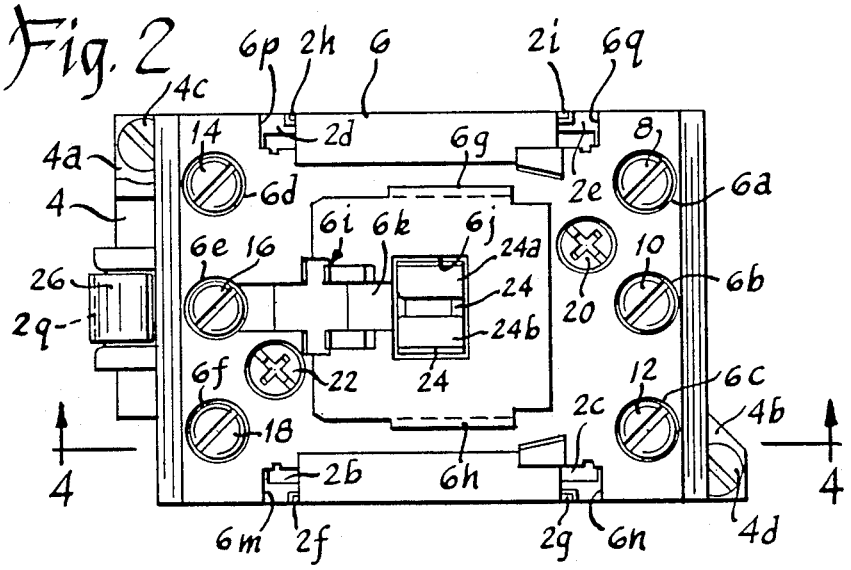
FIG. 2 is a top view of the electromagnetic contactor of FIG. 1 showing the cover thereof and the means for attaching a top adder contact block and operationally connecting the same to the contact carrier of the contactor.
Figure 3:
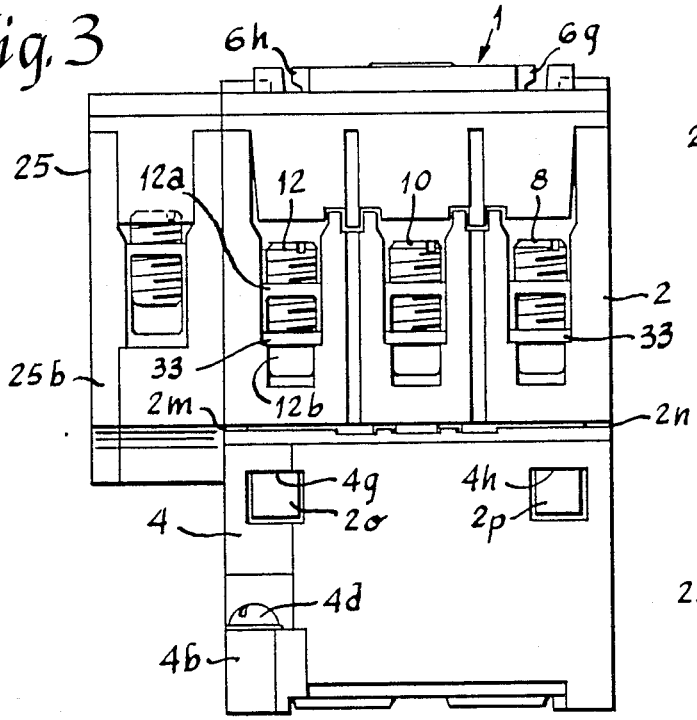
FIG. 3 is a right end elevational view of the contactor of FIGS. 1–2 with a fourth pole added thereto showing the terminals of the three pole contactor and the fourth pole and the apertures whereby the upper housing is hooked to the lower housing.

Referring to FIGS. 1-3, there is shown an electromagnetic contactor 1 constructed in accordance with the invention. As shown therein, the contactor 1 is provided with a molded insulating enclosure comprising an open top upper housing 2 and an open top lower housing 4. Upper housing 2 is joined to and closes the top of lower housing 4 and a cover 6 which forms a part of the upper housing 2 is connected to and closes the top of upper housing 2. Lower housing 4 is provided with a pair of extensions 4*a* and 4*b* at the base of diagonally opposite corners thereof having holes therethrough for screws 4*c* and 4*d* for mounting the contactor onto a mounting plate which is then mounted on a panel or for mounting the contactor directly to a mounting panel, preferably a vertical mounting panel. Cover 6 is provided with two sets of three aligned holes 6*a*–*c* and 6*d*–*f* providing access therethrough to the terminal screws 8, 10, 12 and 14, 16, 18 of the three-pole contacts, these sets of terminal screws being at the right and left ends of upper housing 2 as shown in FIGS. 2 and 3. Cover 6 is attached to the upper housing by a pair of screws 20 and 22 shown in FIG. 2 which thread into corresponding holes in the upper housing such as hole 2*a* shown in FIG. 10 having a tapped insert sonic welded therein.

Cover 6 is also provided at its upper portion with means for sliding and snap-in attachment of a top adder auxiliary contact set. This means comprises a pair of spaced rails 6*g* and 6*h* shown in FIGS. 2 and 3 and a snap-in detent structure indicated generally by 6*i* in FIG. 2. At the center of the cover there is provided an aperture 6*j* through which the upper end of contact carrier 24 extends for connection to the actuator of the auxiliary contact set. For this purpose, the auxiliary contact set is provided with a lateral tongue or the like on the lower end of its contact actuator which slides to the right along groove 6*k* beneath a pair of undercut rails 24*a* and 24*b* on contactor contact carrier 24 to attach them together for actuation of the auxuliary contact set in unison with actuation of the contactor contacts.

Cover 6 is also provided with mounting means including a pair of spaced clearance slots 6*m*, 6*n* and 6*p*, 6*q* on the front and rear edges thereof, respectively, for providing clearance to mount conventional, readily detachable side accessories on opposite sides of upper housing 2. For this purpose, upper housing 2 is provided with a corresponding pair of spaced slots 2*b*, 2*c* and 2*d*, 2*e* at the upper portion of each of its front and rear walls having on the inner edges thereof thin vertical edges 2*f*, 2*g* and 2*h*, 2*i* providing vertical slides for corresponding hooks on the side accessories which grip the same and slide therealong to the bottom of the slots. Upper housing 2 is also provided at the upper central portion of each of its front and rear walls recesses such as recess 2*j* shown in FIGS. 1 and 12 for receiving a detent of a resilient snap-in strip on the side accessory. Upper housing 2 is further provided on the lower central portion of each of its front and rear walls with a vertical opening such as opening 2*k* shown in FIGS. 1 and 12 into which actuating projections 24*c* and 24*d* of the contact carrier extend substantially flush with the outer surface of the wall to be coupled in driving relation with the accessory when it is mounted in place, it being understood that similar projections such as 24*c* and 24*d* extend from the contact carrier into the like opening in the rear wall of upper housing 2. Contact carrier 24 also has a surface which serves as a stop and abuts an internal surface within upper housing 2 to limit the upward movement of the contact carrier under the force of the return spring hereinafter described. Such side accessory can be readily mounted on or detached from this contactor without removing cover 6. For a more detailed illustration and description of a side accessory of the mechanical interlock type and a similar manner of mounting it to the side walls of a contactor, reference may be had to E. M. Butterworth et al U.S. Pat. No. 4,544,814, dated Oct. 1, 1985.

Figure 19:
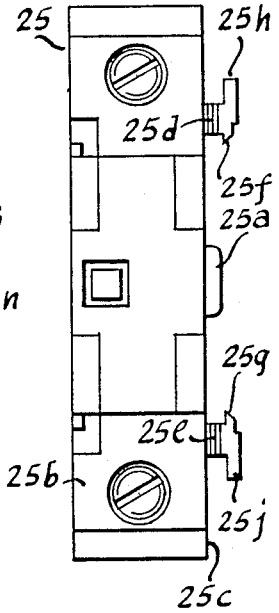
FIG. 19 is a top view of the additional pole mounted on the contactor in FIG. 3.

Alternatively, the aforesaid mounting means may be used to mount an additional pole 25 rather than the aforesaid side accessory to one side of the contactor as shown in FIG. 3. The mounting means for this fourth pole 25 is constructed and arranged so that cover 6 must be removed to mount the fourth pole and then the cover is re-attached by screws 20 and 22 to hold the fourth pole 25 in place and so that it cannot be readily removed. Such fourth pole 25, of course, has a pair of stationary contacts and a movable bridging contact like those in the first three poles, such movable bridging contact being carried by a contact carrier 25*a*. For this purpose, additional pole 25 is provided with the housing 25*b* shown in FIGS. 3 and 19 which has integrally molded at the upper portion of its rear wall 25*c* a pair of mounting members 25*d* and 25*e* having inner hooks 25*f* and 25*g*, respectively, that slide down behind edges 2*f* and 2g of slots 2b and 2c, respectively, while the driver portion of contact carrier 25a that extends out through a hole in housing 25b couples to projections 24c and 24d of the contact carrier 24 of the contactor, all as in the case of the side accessories hereinbefore described. In addition, mounting means 25d and 25e are provided with outer hooks 25h and 25j, respectively, that extend beneath cover 6 outwardly of slots 6m and 6n thereof whereby the cover holds this fourth pole in place so that it will not come off or cannot be removed unless the cover is removed first.

Figure 4:
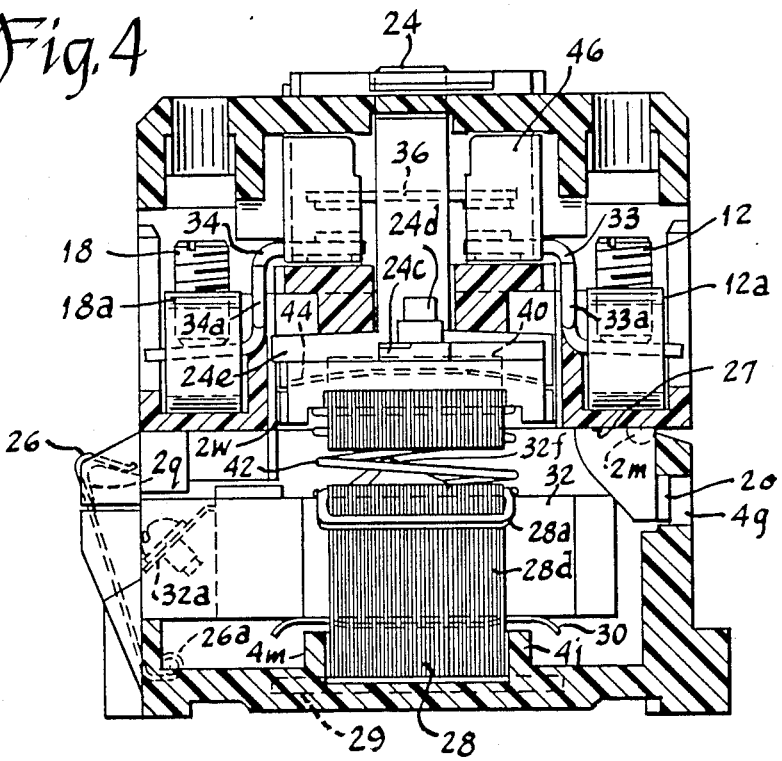
FIG. 4 is a cross sectional view of the contactor of FIGS. 1–3 taken substantially along line 4—4 of FIG. 2 to show the internal mechanism thereof and the means for joining the upper housing to the lower housing.
Figure 12:
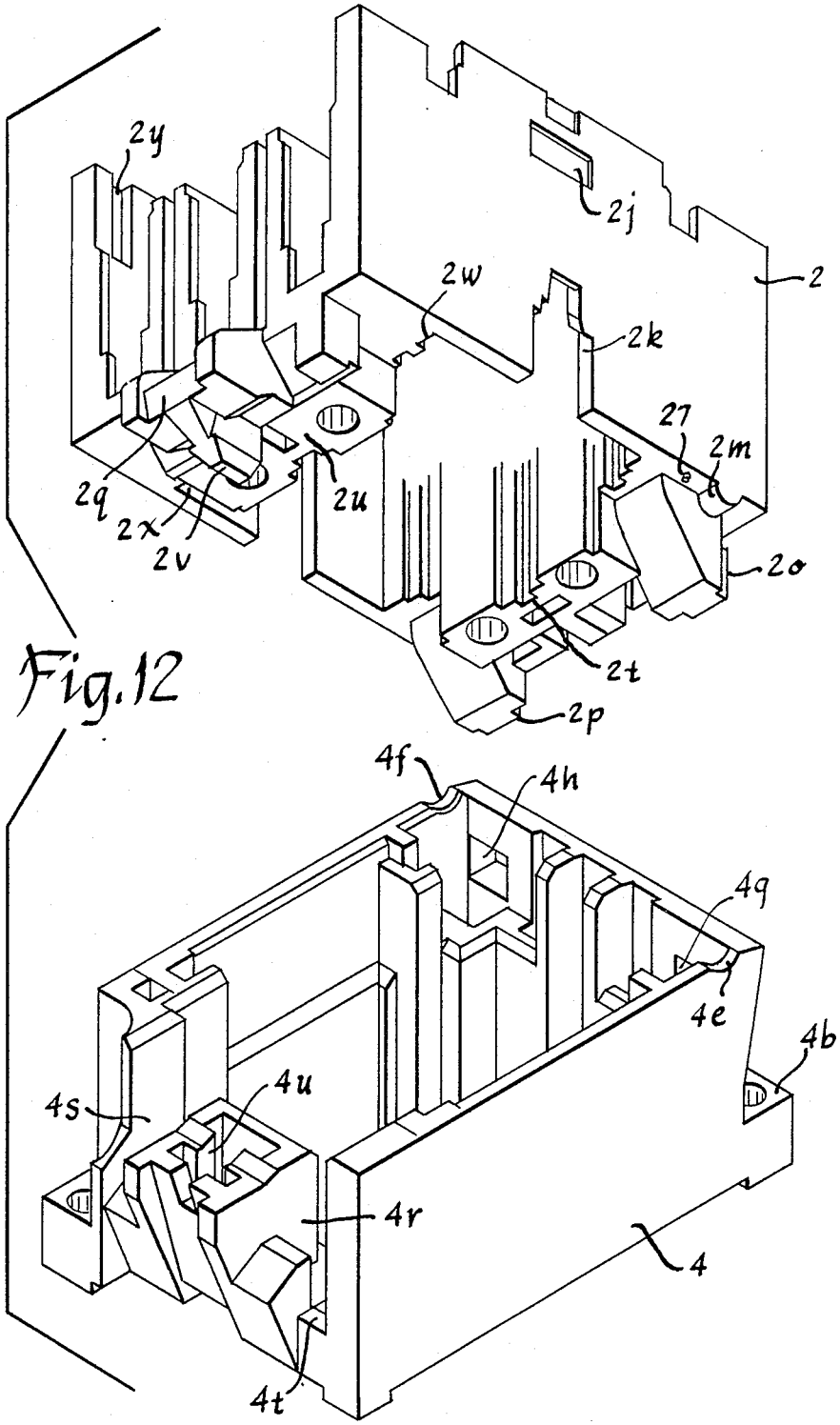
FIG. 12 is an exploded isometric view of the upper and lower housings showing the structure for joining the same.

The upper and lower housings are provided with means for rigidly attaching the same together so as to be readily detachable when desired. This means comprises a pair of spaced rounded projections or half journals 2m and 2n, FIGS. 1, 3 and 12, extending down from the lower right-hand portions of the front and rear walls of upper housing 2 for pivoting in complementary half-circle grooves 4e and 4f in the upper right-hand portions of the front and rear walls of lower housing 4. It will be apparent that these half-circle grooves 4e and 4f and half journals 2m and 2n shown in FIGS. 1, 3 and 12 serve as detents for initially positioning the upper housing onto the lower housing at an upward angle before the upper housing is pivoted down onto the lower housing. For coupling the two housings together, lower housing 4 is provided with a pair of spaced rectangular holes 4g and 4h in the upper portion of its right end wall as shown in FIGS. 3 and 12 for receipt of a pair of lateral projections or hooks 2o and 2p extending downwardly below half journals 2m and 2n as the upper housing is rocked down onto the lower housing. An integrally molded projection 27 adjacent each half journal 2m and 2n is deformed or crushed between the housings 2 and 4 to take up any slack. To complete the joining of the upper housing to the lower housing, a leaf spring clamp 26 is pivotally connected to the lower housing by a snap-in pin the end portions of which are pressed into a pair of aligned grooves extending up from the bottom of lower housing 4 and the bent over hook formed at the upper end of this leaf spring clamp is snapped over a detent 2q at the left-hand end of the upper housing as shown in FIG. 4. To do this, the upper housing is forced down onto the lower housing with sufficient force to develop the necessary bias of the springs and projections 27 and clamp 26 is then snapped over the detent to couple and retain the housings together. In view of the coupling structure provided as hereinbefore described, it will be apparent that the upper housing can be assembled onto and joined with the lower housing only in its correct orientation.

As shown schematically in FIG. 11, lower housing 4 is provided with shock absorber means. This means comprises within the bottom thereof a plurality of spaced parallel wall sections 4j, 4k and 4l aligned thereacross and wall sections 4m, 4n and 4o aligned thereacross in spaced relation to provide a nest for the lower portion of magnet frame 28. Across this nest there are provided two shallow channels 4p and 4q with channel 4p extending to the left between and beyond wall sections 4j and 4k and extending out to the right between wall sections 4m and 4n and, in a similar manner, channel 4q extending out toward the left between and beyond wall sections 4k and 4l and toward the right between and beyond wall sections 4n and 4o. These two channels accommodate two resilient flat strips of rubber 29 and 31 that are thicker than the depth of these channels to serve as cushions for the magnet frame. As shown in FIG. 11, the wall sections have rounded ends that extend slightly into these channels from the opposite sides thereof to grip these rubber strip cushions at their opposite edges and retain them in place once they are pressed into the channels. As will be apparent these rubber strips serve as shock absorbers for the magnet frame when the coil is energized and the armature is attracted thereto to prevent vibration of the contacts.

Figure 7:
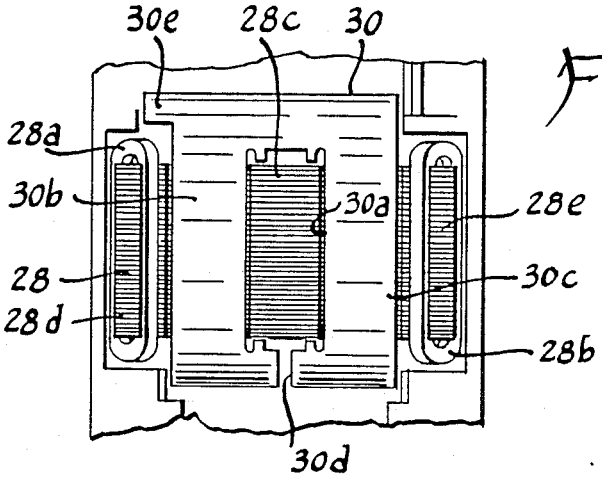
FIG. 7 is a schematic fragmentary top view looking into the lower housing to show the magnet frame and bias spring therein.

As shown in FIG. 7, magnet frame 28 is nested in the base on top of the rubber cushions described in connection with FIG. 11. The outer poles of this magnet frame are provided with grooves for rigidly retaining shading coils 28a and 28b in the usual manner. A bias spring 30 rests within the magnet frame. As shown in FIG. 7, this bias spring 30 has a generally rectangular shape in top view with a generally rectangular hole 30a at the center through which center arm 28c of the magnet frame extends so that side strips 30b and 30c of this bias spring rest on the yoke portions between center arm 28c and outer arms 28d and 2e. This bias spring is downwardly bowed at its center, (FIG. 4) its opposite ends are bent downwardly and it has a narrow slot 30d extending from the center hole to the outer edge at the end thereof extending away from clamp 26. At the other end, bias spring 30 has a lateral projection 30e at one side serving as a key which fits into a corresponding slot in the interior wall of lower housing 4 which insures that this bias spring cannot be incorrectly assembled in the lower housing either in a reversed or upside-down position. Magnet frame 28 being symmetrical can be assembled in the lower housing in either of two 180 degree turned positions so as to function the same either way.

Coil 32 (FIGS. 4 and 13) which is encapsulated in molded insulating material is placed over bias spring 30 so that center arm 28c of the magnet frame extends up through the hole 32d in the coil. A pair of coil terminals 32a and 32b connected to the opposite ends of the coil wire and supported on the coil molding extend into corresponding slots 4r and 4s, FIG. 12, in the left end wall of lower housing 4 so as to be accessible for connecting conductors of an external circuit thereto.

Figure 13:
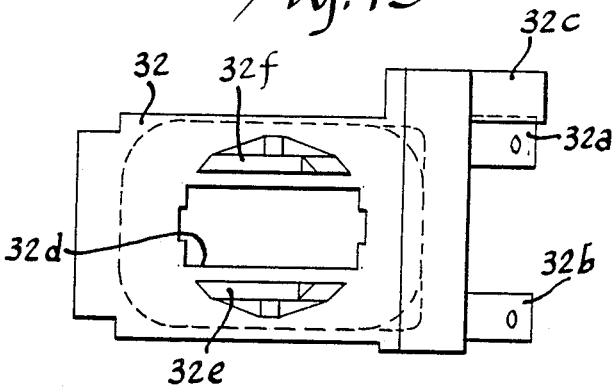
FIG. 13 is a top view of the encapsulated coil showing the pair of inclines at the top thereof and the key for correct assembly thereof within the lower housing.

As shown in FIG. 13, coil 32 is provided with a projection in the form of a key 32c which fits into slot 4t shown in FIG. 12 to key the coil for correct assembly in the lower housing and to prevent assembly of the coil upside-down or in any other incorrect manner.

As will be apparent from the foregoing description, lower housing 4 and the parts assembled thereinto including cushion strips 29 and 31, magnet frame 28, bias spring 30, coil 32 and clamp 26 constitute a first subassembly. A second subassembly includes upper housing 2, the parts mounted therein and cover 6 as hereinafter described.

The aforementioned second subassembly includes upper housing 2, cover 6 and the following parts mounted therein. As shown in FIGS. 2–4, this is a three-pole contactor 1 having three sets of bridging contacts mounted therein with provision for mounting a fourth pole 25. As will be apparent, these three sets of bridging contacts include three pairs of stationary contacts and three movable contacts for bridging the respective pairs of stationary contacts. These three sets of contacts or poles are connected between terminal screws 8–14, 10–16, and 12–18 as shown in FIG. 2. One pole of this contactor is shown in FIG. 4 with the contacts being connected between terminals 12 and 18. This pole includes stationary contacts 33 and 34 and movable contact 36 shown in FIG. 4 in its normally open state.

Each stationary contact is provided on its vertical mid-portion with a pair of short wings on opposite edges thereof, one of which wings 33*a* and 34*a* is shown in FIG. 4 for each of stationary contacts 33 and 34. These wings will retain each stationary contact in place in upper housing 2 when they are slid downwardly into slots such as 2*r* shown in FIG. 10. It will be apparent that different types of connectors may be used with these stationary contacts. If box lugs such as 12*a* and 18*a* shown in FIG. 4 are used, these box lugs are first inserted onto the terminal ends of stationary contacts 33 and 34 and each stationary contact and associated lug is then slid down into upper housing 2 with the wings of the stationary contact sliding down into slot 2*r* and the box lug sliding down into slot 2*s* shown in FIG. 10. These box lugs are shown open in FIG. 3 and closed in FIG. 4. To connect a stripped end of an electrical conductor to the left-hand connector in FIG. 3, for example, the stripped bare end of the conductor is inserted either into space 12*b* between the bottom of box lug 12*a* and the lower surface of the terminal end of stationary contact 32 or between the upper surface of the terminal end of stationary contact 33 and the lower end of screw 12 and connector screw 12 is then turned in to raise the box lug and grip the conductor. The box lug can be freely raised when the screw is not turned all the way in.

Movable contact 36 and the like movable contacts of the other two poles of the contactor are supported and carried by contact carrier 24 in a conventional manner. For this purpose, a helical compression spring (not shown) is supported in a window in the contact carrier above each movable contact such as 36 so that when the contacts are closed, this spring will be partially compressed and provide the required contact pressure for closure of the circuit therethrough.

Figure 5:
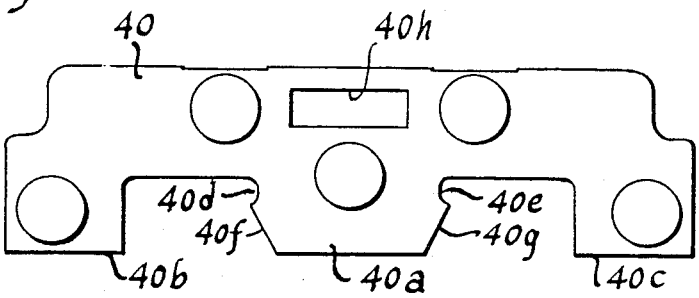
FIG. 5 is an enlarged side elevational view of the armature used in the contactor of FIGS. 1–4.
Figure 6:
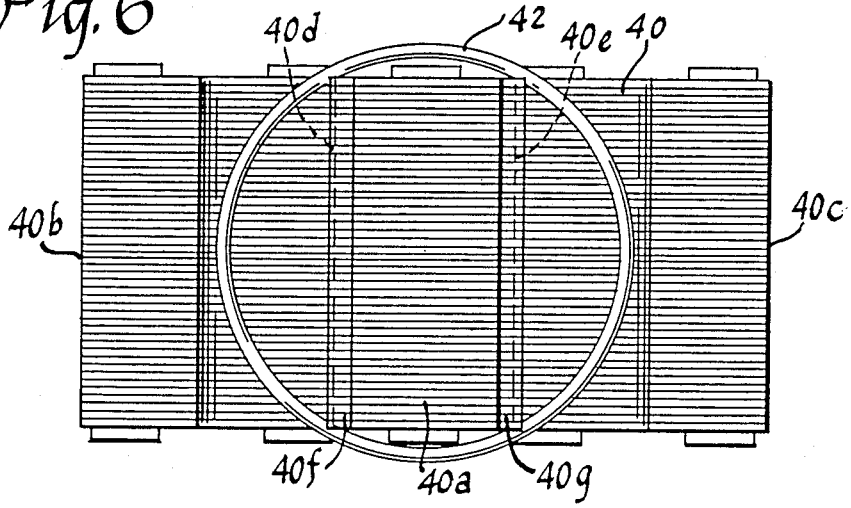
FIG. 6 is a bottom view of the armature of FIG. 5 together with the return spring showing the method of attaching the return spring to the armature.

The armature 40 for the electromagnet is shown in FIGS. 4, 5 and 6. As shown therein, the armature 40 is generally E-shaped having a short center leg 40*a* and short left and right end legs 40*b* and 40*c* spaced therefrom. A pair of generally rounded grooves 40*d* and 40*e* as shown in FIG. 5 are provided along the opposite sides of the base of center leg 48 for retaining a generally helical compression spring 42 as shown in FIG. 6. Also, the left and right sides of center leg 40*a* are tapered from grooves 40*d* and 40*e* inwardly to the tip of the center leg to provide bevels 40*f* and 40*g* to facilitate snap-in attachment of return spring 42 by a press and a twist. As shown in FIG. 6, spring 42 will snap into the ends of grooves 40*d* and 40*e* at the four corners of center leg 40*a* to be retained therein. Armature 40 is also provided with a flat hole 40*h* therethrough for entry of a bowed leaf spring 44 (FIG. 4) whereby the armature is attached to the bottom of contact carrier 24 as shown in FIG. 4.

Figure 17:
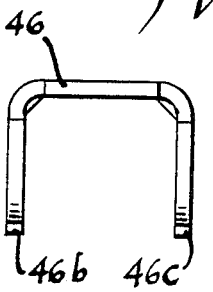
FIG. 17 is an enlarged top view of one of the arc blowout members showing the keyways therein for correct assembly in the cover.
Figure 18:
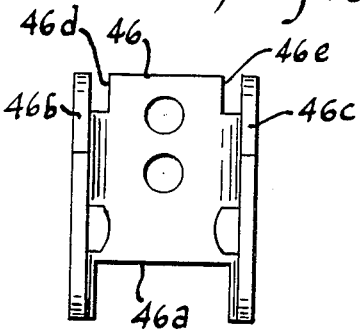
FIG. 18 is an elevational view of the arc blowout member of FIG. 17 showing the contact clearance slot therein.

FIGS. 17 and 18 show an arc extinguishing member or blowout 46. As shown therein, this blowout 46 is a generally U-shaped member having a slot 46*a* in one end of the yoke portion to provide clearance for the stationary contact (as hereinafter described), a pair of keyways 46*b* and 46*c* in the edges of the sidewalls at the other end to insure correct assembly into cover 6 and a pair of slots 46*d* and 46*e* in such other end to lengthen the electrical clearances through slots 6*m*, 6*n*, 6*p* and 6*q* to adjacent electrical devices. For this purpose, cover 6 is provided with friction fit slots for the six blowouts 46. Two of these slots 6*r* and 6*s* are shown in FIG. 8, slot 6*r* being between a relatively shorter raised portion 6*t* and a relatively higher wall 6*u* and slot 6*s* being between a similar raised portion 6*v* and a similar wall 6*w*. These raised portions 6*t* and 6*v* are provided with bevels 6*x* along their edges to facilitate insertion of the blowouts therearound. Slot 6*r* is also provided with an integrally molded key 6*y* at its internal portion for entry into slot 46*c* of a blowout when this blowout is pressed into place. In a similar manner, slot 6*s* is provided with two keys 6*z* at both sides thereof for entry into slots 46*b* and 46*c* when the blowout is pressed into this slot. The blowout slot for the third contact is similar to slot 6*r* except that it is reversed with the key being on the inner side thereof. The slots for the other three blowouts are respectively similar. From this it will be apparent that the blowouts are keyed for only correct assembly into the cover, that is, only the end with keyways 46*b* and 46*c* can be inserted into the cover and if it is attempted to insert the other end of the blowout into the cover, keys 6*y* and 6*z* will block entry thereof.

Upper housing 2 and cover 6 are provided with means insuring only correct orientation thereof in assembly. This means comprises a pair of vertically elongated keys on the corners of the left end of the cover, one of which keys 7*a* is shown in FIGS. 8 and 9, that slide down into a complementary pair of keyways 2*y* and 2*z* within the left end of upper housing 2 as shown in FIGS. 10 and 12. Since the other end of upper housing 2 does not have similar keyways, the cover can be assembled only in its correct direction. Since the contact carrier is also keyed to the upper housing as hereinafter described, the means on the cover and contact carrier for snap-in attachment of the top adder auxiliary contact set will always be correctly oriented after assembly.

As shown in FIGS. 4 and 13, molded coil 32 is provided on opposite sides of center hole 32*d* thereof with a pair of integrally molded raised inclines 32*e* and 32*f* to insure correct positioning of return spring 42 when the upper housing subassembly is rocked onto the lower subassembly. Referring to FIG. 4, it will be apparent that when the two half trunions 2*m* and 2*n*, shown also in FIGS. 3 and 12, of the upper housing are inserted into grooves 4*e* and 4*f* of the lower housing, shown in FIG. 12, and the upper housing subassembly is then rocked counterclockwise so that hooks 2*o* and 2*p* enter apertures 4*g* and 4*h*, the lowest portion of return spring 42 will engage inclines 32*e* and 32*f* on top of coil 32 and will slide down and along these inclines into position upon the upper surface of coil 32 as the upper housing subassembly is pressed onto the lower housing subassembly and clamp 26 snapped in place. These inclines 32*e* and 32*f* insure that return spring 42 will always be assembled in the correct centered positon within the contactor. As the upper housing is pressed onto the lower housing, flat bottom portions 2*t* and 2*u* of upper housing 2 shown in FIG. 12 will abut the flat upper surfaces of coil 32 and press this coil down to partially flatten and stress bowed bias spring 30 thereby also pressing magnet frame 28 securely down on and compressing cushions 29 and 31 that are located in the bottom of lower housing 4. At the same time, projection 2*v* at the bottom left portion of upper housing 2 which has a tapered lower end as shown in the upper portion of FIG. 12 enters slot 4*u* in the lower housing shown at the lower portion of FIG. 12 to insure that the upper housing is correctly positioned with respect to the lower housing. The two projections 27 are compressed to take up any slack between the upper and lower housings.

From the foregoing, it will be apparent that bias spring 30 performs a number of functions as follows. It allows the magnet frame to move sufficiently to line up with the armature when the coil is energized. It assists in taking up any slack between the housings so that hooks 2*o* and 2*p* will remain tight against the upper edges of apertures 4*g* and 4*h* under shock and vibration. It biases the coil against the upper housing to prevent undesired movement thereof. It prevents the coil from moving in relation to the magnet frame so that the coil will abut and be held tight against the upper housing. And it is keyed to the lower housing as hereinbefore described so that it cannot be assembled incorrectly.

Contact carrier 24 is keyed into the upper housing 2 so that it can be inserted from below thereinto only in the correct orientation. For this purpose, contact carrier 24 is provided with a pair of short lateral projections at its left lower portion one of which projections 24*e* is shown in FIG. 4 to be received in complementary grooves 2*w* and 2*x* in the interior of the upper housing as shown in FIGS. 4 and 12. This keying of the contact carrier is necessary because the extreme upper portion thereof and the cover are constructed so that the auxiliary switch can be coupled thereto only by sliding it in the direction from the left toward the right as viewed in FIG. 2.

Figure 14:
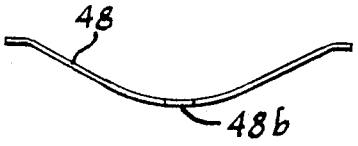
FIG. 14 is a side view of an auxiliary bias spring that is used in a modification of the contactor shown in FIG. 16.
Figure 15:
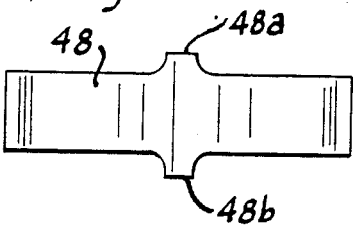
FIG. 15 is a top view of the auxiliary bias spring of FIG. 14.
Figure 16:
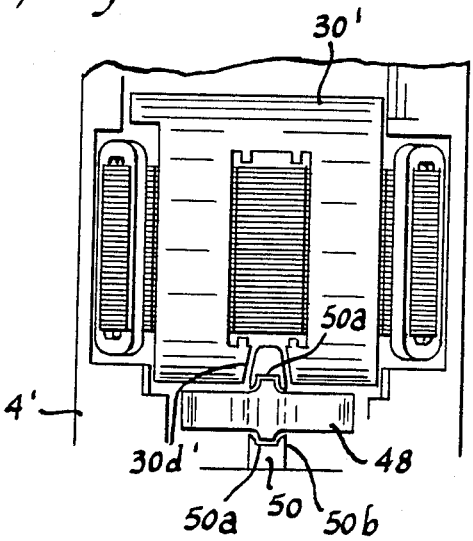
FIG. 16 is a top view like FIG. 7 looking down into the lower housing of the modified contactor to show the magnet frame, the modified bias spring and the auxiliary bias spring of FIGS. 14 and 15 mounted therein.

A modification of the invention is shown in FIGS. 14, 15 and 16. This modification or alternative construction allows selection of a spring 30' that applies the desired amount of bias force between the magnet frame and the coil so as to allow sufficient movement of the magnet frame for alignment with the armature while the coil remains stationary against the upper housing. This of course prevents damage and wear to the magnet parts and greatly lengthens the life thereof because the armature will always be drawn flat against the magnet frame poles rather than in a tilted manner which otherwise would cause damage and wear. This modification also allows selection of an auxiliary spring 48 that functions together with spring 30' to apply the proper amount of bias force to the coupling structure of the upper and lower housings to keep them tight relative to one another under shock and vibration.

As shown in FIGS. 14–16, this modification requires a small change from spring 30 to spring 30' to provide a wider tapered slot 30*d'* in the corresponding end thereof to provide clearance for a mounting structure 50 for auxiliary spring 48. This mounting structure 50 may be molded integrally in the bottom of a modified lower housing 4'. As shown in FIGS. 14 and 15, auxiliary spring 48 is generally a rectangular strip bowed downwardly at its center portion and its opposite ends bent slightly downwardly to provide smooth upper surfaces at its end portions for abutting engagement with the lower surface of the molded coil. Spring 48 is also provided at its center portion with oppositely directly short retaining projections 48*a* and 48*b* that bite into the end notches 50*a* of a slot 50*b* in mounting structure 50 as shown in FIG. 16. Notches 50*a* are each preferably provided with a small vertical ridge in the wall thereof for biting engagement by projections 48*a* and 48*b* as auxiliary spring 48 is pressed down into slot 50*b*. As will be apparent, this modification requires a slightly modified lower housing to provide mounting structure 50, a slightly modified bias spring 30' and the addition of auxiliary spring 48. This allows bias spring 30' to be constructed with less bias force than bias spring 30 so as to allow adequate movement of magnet frame 28 while auxiliary spring 48 together with bias spring 30' provides the necessary bias force to keep the coil and lower and upper housing coupling structure tight under shock and vibration conditions.

While the apparatus hereinbefore described is effectively adapted to fulfill the objects stated, it is to be understood that the invention is not intended to be confined to the particular preferred embodiments of electromagnetic contactor having improved structure and assembly disclosed, inasmuch as it is susceptible of various modifications without departing from the scope of the appended claims.

I claim:

1. An electromagnetic contactor having a molded insulating enclosure including a lower housing and an upper housing including means fixing said upper housing onto said lower housing and connecting the same together, stationary and movable contacts in said upper housing, an insulating molded contact carrier supporting said movable contacts and means guiding said contact carrier for reciprocal movement in said upper housing, an electromagnet comprising an E-shaped magnet frame, a coil, means supporting said magnet frame and coil in said lower housing, an armature secured to said contact carrier and a return spring normally biasing said armature away from said frame for attraction by said magnet frame when said coil is energized to operate said contacts; characterized in that said means fixing said upper housing and said lower housing comprise:

retaining means in one end of said upper housing and said lower housing cooperatively engagable to afford hooking of said upper housing onto said lower housing at said one end and pivoting the other end of said upper housing about said cooperatively engaged retaining means into assembled position on said lower housing;

resilient press-in clamp securing means for attaching said other end of said upper housing to said lower housing to join said upper housing to said lower housing;

and means operable to insure correct location of said return spring as said upper and lower housings are joined comprising means for attaching said return spring to said armature; and said coil being encased in molding material having raised incline means for engagement by said return spring whereby to guide said return spring slidingly therealong into correct location when said other end of said upper housing is pivoted into said assembled position on said lower housing and said housing are secured together.

2. The electromagnetic contactor claimed in claim 1, wherein said upper housing comprises:

an open top housing portion having together with said contact carrier said means guiding said contact carrier for reciprocal movement in said open top housing portion;

means in said open top housing portion mounting said stationary contacts;

means on said contact carrier mounting said movable contacts;

a molded insulating cover secured to and closing the top of said open top housing portion;

and arc blowout members press-in mounted in said cover so as to embrace in closely spaced relation the contacting portions of said stationary and movable contacts.

3. The electromagnetic contactor claimed in claim 2, wherein:

said cover and said arc blowout members comprise means limiting press-in mounting of said arc blowout members in said cover only one way so that said arc blowout members will be in correct relation to said stationary and movable contacts when said cover is secured to said open top housing portion.

4. The electromagnetic contactor claimed in claim 3, wherein:

said open top housing portion and said cover are provided with means keying them for correct assembly relative to one another.

5. An electromagnetic contactor having a molded insulating enclosure including a lower housing and an upper housing, stationary and movable contacts in said upper housing, an insulating molded contact carrier supporting said movable contacts and means guiding said contact carrier for reciprocal movement in said upper housing, an electromagnet comprising an E-shaped magnet frame, a coil, means supporting said magnet frame and coil in said lower housing, an armature securd to said contact carrier, a return spring normally biasing said armature away from said frame for attraction by said magnet frame when said coil is energized to operate said contacts, means fixing said upper housing onto said lower housing comprising retaining means in one end of said upper housing and said lower housing cooperatively engagable to afford hooking of said upper housing onto said lower housing at said one end and pivoting the other end of said upper housing about said cooperatively engaged retaining means into assembled position on said lower housing, securing means for attaching said other end of said upper housing to said lower housing to join said upper housing to said lower housing, and means operable to insure correct location of said return spring as said upper and lower housings are joined;

wherein said armature comprises an E-shaped member having three short legs including a center leg and outer legs;

said return spring has a generally helical wire shape;

said coil comprises a wire wound bobbin encased in molded insulating material;

and said means insuring correct location of said return spring comprises:

grooves at the peripheral portions of the base of said center leg and said center leg having bevels from said grooves toward the end thereof;

an inner diameter at the upper end of said wire spring small enough to slide along said bevels and snap into said grooves so that said spring may be snap-in attached to said armature by a press and a twist in assembly to be retained thereon;

and a pair of spaced raised inclines on said molded coil for engagement by the lower end of said spring which guide said lower end of said spring sligingly along said inclines into correct centered location when said upper housing is pivoted onto said lower housing.

6. The electromagnetic contactor claimed in claim 5, wherein:

said center leg of said armature is generally rectangular in cross-section;

said grooves comprise rounded channels along the opposite sides of said base of said center leg;

and said bevels comprise inwardly angled surfaces from said channels to the tip of said center leg.

7. An electromagnetic contactor having a molded insulating enclosure including a lower housing and an upper housing;

an electromagnet comrising an E-shaped magnet frame, a coil, means supporting said magnet frame and coil in said lower housing;

said upper housing comprising an open top housing portion, stationary contacts mounted in said open top housing portion, an insulating molded contact carrier guided for reciprocal movement in said open top housing portion, movable contacts mounted on said contact carrier, an armature secured to said contact carrier, a molded insulating cover secured to and closing the top of said open top housing portion, arc blowout members press-in mounted in said cover so as to embrace in closely spaced relation contacting portions of said stationary and movable contacts, and a return spring normally biasing said armature away from said frame for attraction by said magnet frame when said coil is energized to operate said contacts;

means fixing said upper housing onto said lower housing comprising retaining means in one end of said upper housing and said lower housing cooperatively engagable to afford hooking of said upper housing onto said lower housing at said one end and pivoting the other end of said upper housing about said cooperatively engaged retaining means into assembled position on said lower housing, securing means for attaching said other end of said upper housing to said lower housing, and means operable to insure correct location of said return spring as said upper and lower housings are joined;

wherein said open top housing portion comprises on opposite sides thereof mounting means for an additional pole comprising:

a pair of slots at the top of each said side each having vertical edges for receiving downwardly slidable hooks of an additional pole;

and said additional pole having double-pronged hooks with at least one of said prongs of each hook being retained by said cover.

8. The electromagnetic contactor claimed in claim 5, wherein:

said means supporting said magnet frame and said molded coil in said lower housing comprises:

means defining a pocket in said lower housing for accommodating said magnet frame;

abutments in said lower housing confining said molded coil so that said molded coil surrounds said center leg of said magnet frame;

resilient means between said magnet frame and said molded coil;

and abutments on the lower portion of said upper housing pressing on said molded coil to compress said resilient means when said upper housing is joined to said lower housing.

9. The electromagnetic contactor claimed in claim 5, wherein:

said means supporting said magnet frame and said molded coil in said lower housing also comprises:

second resilient means between said magnet frame and said lower housing acting jointly with said first resilient means to allow said magnet frame to move to line up with said armature, to take up any slack between said upper and lower housings so that said securing means will be tight, to bias said molded coil against said upper housing and to hold said molded coil from moving relative to said housings.

10. The electromagnetic contactor claimed in claim 8, wherein:

said resilient means between said magnet frame and said molded coil is a leaf spring;

and said leaf spring and said lower housing comprise means keying said leaf spring for assembly in said lower housing only in the correct orientation.

11. The electromagnetic contactor claimed in claim 10, wherein:

said leaf spring is a generallly rectangular flat leaf spring having a hole at its center through which said center leg of said magnet frame extends and the strips on opposite sides of said hole being downwardly bowed to rest on the yoke portions between the legs of said magnet frame and having end portions overhanging said magnet frame and being upwardly bowed to bear against the bottom surface of said molded coil.

12. The electromagnetic contactor claimed in claim 11, wherein:

said means keying said leaf spring comprises a projection at one corner thereof accommodated in a clearance slot in a corresponding location in said lower housing.

13. An electromagnetic contactor having a molded insulating enclosure including a lower housing and an upper housing, stationary and movable contacts in said upper housing, an insulating molded contact carrier supporting said movable contacts and means guiding said contact carrier for reciprocal movement in said upper housing, an electromagnet comprising an E-shaped magnet frame, a coil, means supporting said magnet frame and coil in said lower housing, an armature secured to said contact carrier, a return spring normally biasing said armature away from said frame for attraction by said magnet frame when said coil is energized to operate said contacts, means fixing said upper housing and said lower housing comprising retaining means in one end of said upper housing and said lower housing cooperatively engagable to afford hooking of said upper housing onto said lower housing at said one end and pivoting the other end of said upper housing about said cooperatively engaged retaining means into assembled position on said lower housing, securing means for attaching said other end of said upper housing to said lower housing to join said upper housing to said lower housing, and means operable to insure correct location of said return spring as said upper and lower housings are joined;

wherein one of said housings comprises integrally molded projections abutting the other housing and being compressed therebetween when said housings are attached together to take up slack therebetween.

* * * * *